US007830332B2

(12) United States Patent
Park et al.

(10) Patent No.: US 7,830,332 B2
(45) Date of Patent: Nov. 9, 2010

(54) MULTI-DISPLAY DRIVING CIRCUIT AND METHOD OF DRIVING DISPLAY PANELS

(75) Inventors: Sang-Yong Park, Yongin-si (KR); Min-Seok Song, Seoul (KR); Hyeok-Chul Kwon, Yongin-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 1247 days.

(21) Appl. No.: 11/364,660

(22) Filed: Feb. 28, 2006

(65) Prior Publication Data

US 2006/0214873 A1 Sep. 28, 2006

(30) Foreign Application Priority Data

Mar. 24, 2005 (KR) ..... 10-2005-0024400

(51) Int. Cl.
*G09G 5/00* (2006.01)

(52) U.S. Cl. ..... 345/1.1

(58) Field of Classification Search ..... 345/1.1–3.4
See application file for complete search history.

(56) References Cited

U.S. PATENT DOCUMENTS 4,855,728 A * 8/1989 Mano et al. ..... 345/3.2
5,218,274 A * 6/1993 Zenda ..... 315/366
5,534,883 A * 7/1996 Koh ..... 345/3.2
6,574,487 B1 6/2003 Smith et al. ..... 455/566
6,924,843 B1 * 8/2005 Yamazaki et al. ..... 348/423.1
7,030,837 B1 * 4/2006 Vong et al. ..... 345/1.3
2002/0067318 A1 * 6/2002 Matsuzaki et al. ..... 345/1.1
2002/0186213 A1 * 12/2002 Koizumi ..... 345/208
2003/0033417 A1 * 2/2003 Zou et al. ..... 709/230
2003/0063041 A1 * 4/2003 Kurashima et al. ..... 345/1.1
2003/0095306 A1 * 5/2003 Divelbiss et al. ..... 359/115
2004/0021616 A1 * 2/2004 Goto et al. ..... 345/1.1
2004/0080521 A1 * 4/2004 Nose et al. ..... 345/690
2004/0150596 A1 * 8/2004 Uchida et al. ..... 345/84
2004/0169618 A1 * 9/2004 Nakai et al. ..... 345/1.1
2005/0030254 A1 * 2/2005 Jung et al. ..... 345/1.1
2005/0083274 A1 * 4/2005 Beddes et al. ..... 345/82

(Continued)

FOREIGN PATENT DOCUMENTS

JP 2002-374333 12/2002

(Continued)

*Primary Examiner*—Chanh Nguyen
*Assistant Examiner*—Robert M Stone
(74) *Attorney, Agent, or Firm*—F. Chau & Associates, LLC

(57) ABSTRACT

A multi-display (e.g., dual-display) driving circuit includes a first display driving circuit configured to receive a first display signal and a second display signal from an external source (e.g., CPU) through a first interface, and to drive a first display panel in response to the first display signal and to output the second display signal through a second interface of the first display driving circuit. The second display signal is transmitted via the second interface to a second driving circuit configured to drive a second display panel. Therefore, the complexity of the wiring (e.g., through a hinge of a folding phone, and between a CPU and first and second displays) of the multi-display device may be reduced, and the electromagnetic interference (EMI) characteristics of the multi-display device may be enhanced.

7 Claims, 8 Drawing Sheets

U.S. PATENT DOCUMENTS

| | | | | |
|---|---|---|---|---|
| 2005/0088364 | A1* | 4/2005 | Matsuhira et al. | 345/1.1 |
| 2005/0116919 | A1* | 6/2005 | Shin | 345/100 |
| 2005/0253778 | A1* | 11/2005 | Ku et al. | 345/1.3 |
| 2007/0057865 | A1* | 3/2007 | Song et al. | 345/1.1 |

FOREIGN PATENT DOCUMENTS

| | | |
|---|---|---|
| KR | 2001-16833 | 3/2001 |
| KR | 2004-36945 | 5/2004 |

* cited by examiner

303

MULTI-DISPLAY DRIVING CIRCUIT AND METHOD OF DRIVING DISPLAY PANELS

CLAIM FOR PRIORITY

This application claims priority, under 35 U.S.C. §119, of Korean Patent Application No. 2005-24400 filed on Mar. 24, 2005 in the Korean Intellectual Property Office (KIPO), the entire contents of which are hereby incorporated by reference.

BACKGROUND OF THE INVENTION

1. Field of the Invention

The present invention relates to a display driving circuit, and more particularly to a multi-display driving circuit used in a multi-display device and a method of driving a plurality of display panels.

2. Description of the Related Art

The latest electronic devices, such as G3 "clamshell" phones may have a dual display configuration including a main display panel and a sub-display panel. The sub-display panel may display subset of the information displayed by the main display panel (e.g., a relatively small amount of information compared with the main display panel). Further, the display device may have a multi-display that comprises three display panels.

For example, in the case of folding type ("clamshell") mobile phones, the main display panel is located on the inner side of a folding cover (and displays a phone number while dialing and an elapsed time during a phone call, etc.,) while the sub-display is located on the outer side of the folding cover (and displays a caller ID, a signal reception strength indicator during standby mode, a clock and remaining battery power, etc.).

The dual display enhances the ease of use and function of products; however, the dual display may have an interface problem between a central processing unit (CPU) and two driving circuits (e.g., one driving circuit for driving each of the display panels).

FIG. 1 is a block diagram illustrating a conventional multi-display driver circuit.

Referring to FIG. 1, the conventional dual-display system 100 including a conventional dual-display driver circuit (102, 104, 106, 107). The conventional dual-display system 100 includes a first display panel 101, a first display driver circuit 102 for driving the first display panel 101, a second display panel 103, a second display driver circuit 104 for driving the second display panel 103, and a CPU 105.

The conventional dual-display driver circuit comprises a first display driver circuit 102 coupled to the CPU 105 via a first interface 106 and the second display driver circuit 104 is coupled to the CPU 105 via a second interface 107, as shown in FIG. 1.

Thus, as the number of the display driver circuits increases, the wiring complexity between the CPU and the display driver integrated circuits (IC) increases, and thus electromagnetic interference (EMI) characteristics deteriorate.

In addition, according to the trend towards multimedia, a display device may be required to output moving images having a high resolution or to output real-time images received from a camera, and thus the quantity of the data that must be transferred from the CPU to the display driver circuits has increased.

In a new data transfer standard, a conventional parallel data transfer method between the CPU and the display driver IC is replaced by a serial differential data transfer method. The serial differential data transfer method provides a high data transfer rate, a low EMI and a reduced wiring complexity. The connection wires between the baseband modem chip and the display driver IC may be greatly reduced compared to the conventional parallel data transfer method. For example, 30 to 40 wires between the baseband modem chip and the display driver IC may be reduced to just 4 wires plus power in the MDDI specification. MDDI is a high-speed digital packet serial interface, which allows for bidirectional data transfer and has a maximum bandwidth of up to 3.2 Gbits per second. This allows designs using up to 90 wires to interconnect the upper and lower clamshell through parallel interfaces to be reduced significantly. MDDI generally enables low-power, high-speed graphics performance for advanced multimedia clamshell phones equipped with high-resolution LCD displays.

Qualcomm, Inc. proposed the data transfer standard for mobile displays, known as a Mobile Digital Display Interface (MDDI). In the MDDI specification, data are transferred between the CPU (for example, a baseband modem chip) and a display driver IC using a serial differential data transfer method.

According to the MDDI specification, it is possible to achieve a maximum data transfer rate of 400 megabits/second in type 1, and a maximum data transfer rate of 3.2 gigabits/second in type 4.

However, the conventional multi-display device (e.g., the conventional clamshell phone) typically has one display driver IC that supports the MDDI interface and a second display driver IC that supports the conventional parallel data transfer interface.

For example, the first display driver IC for driving the main display panel supports the MDDI interface; however, the second display driver IC for driving the sub-display panel supports the conventional parallel data transfer interface. Thus, in the conventional multi-display device, the wiring complexity and the EMI characteristics cannot be greatly enhanced even when the display driver IC supports a serial differential interface (e.g., MDDI).

SUMMARY OF THE INVENTION

Aspects of the present invention provide a multi-display driving circuit that may reduce the complexity of wiring and enhance electromagnetic interference (EMI) characteristics.

Aspects of the present invention also provide a display driving circuit that may reduce complexity of wiring and enhance EMI characteristics.

Aspects of the present invention also provide a method of driving a plurality of display panels that may reduce the complexity of wiring and enhance EMI characteristics.

Some aspects of the present invention provide a multi (e.g., two, three)-display driving circuit comprising: a first display driving circuit configured to receive a first display signal and a second display signal from an external source through a first interface, and configured to drive a first display panel in response to the first display signal and to output the second display signal through a second interface; and a second driving circuit configured to drive a second display panel in response to the second display signal outputted through the second interface. The multi-display driving circuit naturally may be interfaced with a first display panel and a second display panel.

In various embodiments of the invention, the first interface may be a serial differential interface (e.g., MDDI). The first interface may be a packet interface, and the first and the second display signals may be encoded into packet data, and the packet data may be inputted to the first display driver circuit from an external source. Meanwhile, the second interface may be a parallel interface. The first display signal may include first pixel data and a first control signal for driving the first display panel, and the second display signal may include second pixel data and a second control signal for driving the second display panel.

In some exemplary embodiments of the present invention, a display driving circuit comprises: a first interface unit configured to receive a first display signal and a second display signal through a first interface; a signal discriminating circuit configured to discriminate the received first display signal from the received second display signal; a signal distributing circuit (e.g., a demultiplexer unit) configured to output the first display signal and to (separately) output the second display signal based on a discrimination result of the signal discriminating circuit; a first driver logic circuit configured to drive a first display panel based on the first display signal; and a second interface unit configured to convert the second display signal outputted from the signal distributing circuit (e.g., the demultiplexer unit) into a signal conforming to the second interface and to output the signal conforming to the second interface.

In further embodiments, the signal discriminating circuit may generate a panel select signal for selecting one of the first display panel and the second display panel based on at least one of the first and the second display signals. The signal distributing circuit (e.g., a demultiplexer unit) may divide signals outputted from the first interface unit into the first display signal and the second display signal in response to the panel select signal to output the first display signal and the second display signal. The signal distributing circuit (e.g., a demultiplexer unit) may include at least one demultiplexer respectively having at least one demultiplexer, the at least one demultiplexer performing a demultiplexing operation in response to the panel select signal.

In still further embodiments, the second interface may be an 80-mode parallel interface. The second interface unit may include: a signal receiver configured to receive the second display signal outputted from the signal distributing circuit; a first counter and a second counter configured to count a clock signal to determine a time point for toggling a signal conforming to the 80-mode parallel interface; a signal generating unit configured to generate the signal conforming to the 80-mode parallel interface based on the second display signal, a first count value of the first counter and a second count value of the second counter; and a flip-flop unit having a plurality of flip-flops configured to transfer the signal conforming to the 80-mode parallel interface in response to the clock signal.

Additional aspects of the present invention provide a method of driving at least two display panel comprising: receiving a first display signal and a second display signal through a first interface by (into) a first display driving circuit; discriminating the received first display signal from the received second display signal to (separately) output the first display signal and the second display signal; and converting the second display signal into a signal conforming to a second interface to transfer the signal conforming to the second interface to a second display driving circuit. This method may be employed for driving a first display panel based on the first display signal and driving a second display panel based on the signal conforming to the second interface.

In further embodiments of the invention, the first interface may be a serial differential interface. The first interface may be a packet interface, the first and the second display signals may be encoded into packet data, and the packet data may be inputted to the first display driver circuit from an external source. Meanwhile, the second interface may be a parallel interface. The first display signal may include first pixel data and a first control signal for driving the first display panel, and the second display signal may include second pixel data and a second control signal for driving the second display panel.

Exemplary embodiments of the present invention are disclosed herein. However, specific structural and functional details disclosed herein are merely representative for purposes of describing exemplary embodiments of the present invention; however, other embodiments of the present invention may be embodied in many alternate forms and should not be construed as limited to exemplary embodiments of the present invention set forth herein.

While the invention is susceptible to various modifications and alternative forms, specific embodiments thereof are shown by way of example in the drawings and will herein be described in detail below. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

It will be understood that, although the terms first, second, etc. may be used herein to describe various elements, these terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention to those particular embodiments. As used herein, the singular forms "a", "an" and "the" are intended to include the plural forms as well, unless the context clearly indicates otherwise. It will be further understood that the terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

BRIEF DESCRIPTION OF THE DRAWINGS

Features of the present invention will become more apparent to persons skilled in the art by describing in detail exemplary embodiments of the present invention with reference to the accompanying drawings, in which.

DETAILED DESCRIPTION OF THE EXEMPLARY EMBODIMENTS

Figure 1:
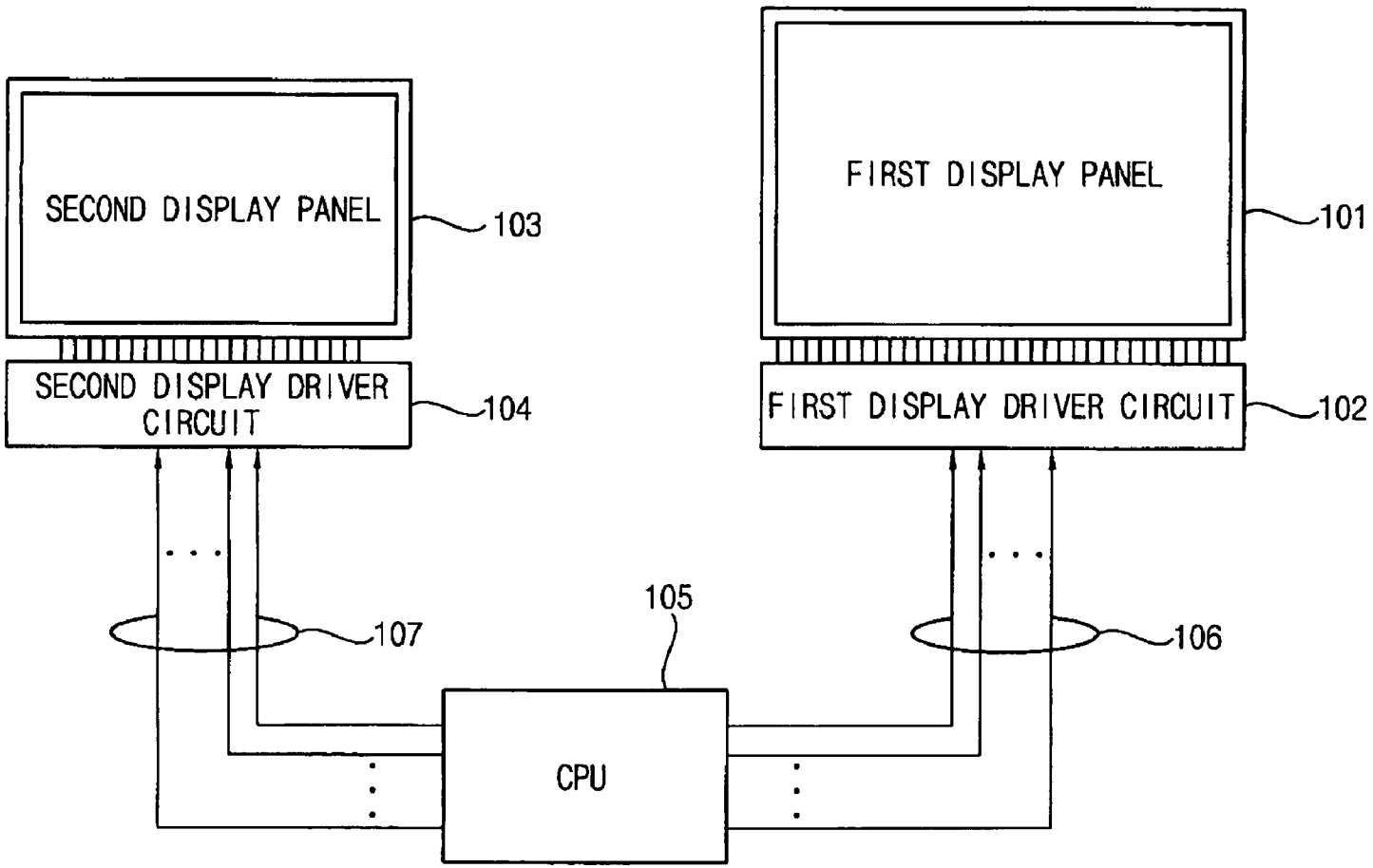
FIG. 1 (PRIOR ART)
FIG. 1 is a block diagram illustrating a dual-display driver system including a conventional dual-display driver circuit.
Figure 2:
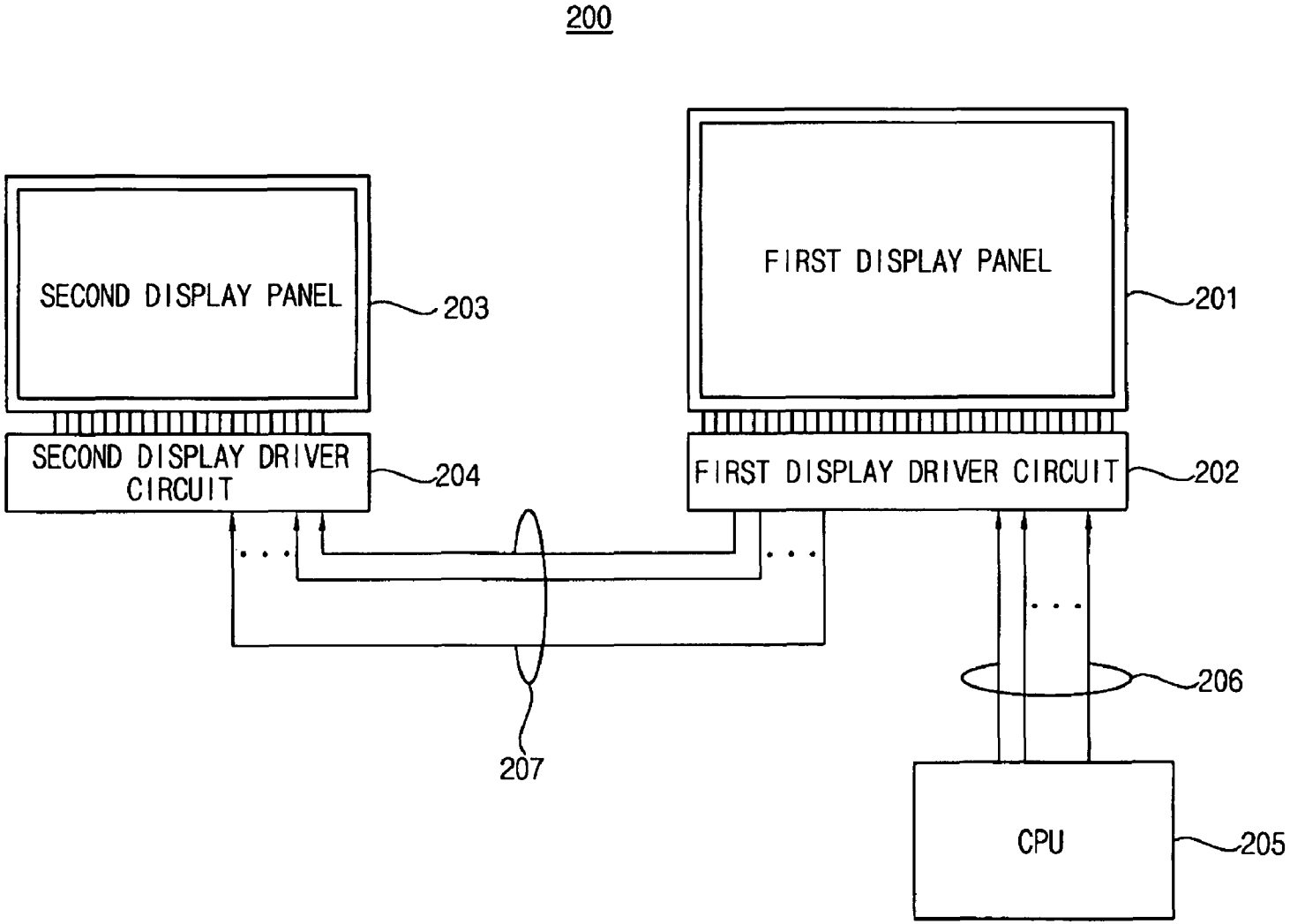
FIG. 2 is a block diagram illustrating a dual-display system including a dual-display driver circuit according to an exemplary embodiment of the present invention.

FIG. 2 is a block diagram illustrating a dual-display system 200 according to an exemplary embodiment of the present invention.

Referring to FIG. 2, the dual-display system 200 includes a first display panel 201, a second display panel 203, a central processing unit (CPU) 205, and a dual-display driver circuit (202, 204, 306, 207) according to an exemplary embodiment of the present invention.

The dual-display driver circuit comprises a first display driver circuit 202 for driving the first display panel 201, a second display driver circuit 204 for driving the second display panel 203.

The first display driver circuit 202 has at least two interfaces 206 and 207. The first display driver circuit 202 receives a first display signal and a second display signal through the first interface 206, drives the first display panel 201 in response to the first display signal, and outputs the second display signal to the second display panel 204 through the second interface 207.

The first interface 206 may be a high-speed serial differential interface. For example, the high-speed serial differential interface may be the Mobile Digital Display Interface (MDDI).

The first display signal and the second display signal may be received from an external source such as the CPU 205 or a video controller (not shown), through the first interface 206. For example, the first display signal and the second display signal may be received from a baseband modem chip of a mobile communication terminal. The mobile communication terminal includes a built-in CPU core, and the baseband modem chip may be implemented with a System-on-Chip (SOC).

The first display signal and the second display signal may include pixel data, which are to be displayed on the first and/or the second display panels 201 and 203, and various kinds of control signals.

The first and the second display signals may be selectively received in sequence or simultaneously. For example, when the high-speed serial differential interface is a packet type interface, a first packet having the first display signal and a second packet having the second display signal may be simultaneously received, or the second display signal may be a subset of the first display signal.

The second interface 207 may be an interface different type than the first interface 206. The second interface 207 may be a different kind of high-speed serial differential interface rather than same high-speed serial differential interface of the first interface 206. The second interface 207 may be a parallel interface. For example, the second interface 207 may be an 80-mode, 16-bit parallel interface or an 80-mode, 18-bit parallel interface.

The second display panel 203 may have a resolution lower than that of the first display panel 201 and/or have a color depth smaller than that of the second display panel 201. Thus, the second interface 207 may be a parallel interface having a lower speed compared with the first interface 206. However, the second interface 207 may be an interface equivalent to, or alternatively superior to, the first interface 206.

Figure 3:
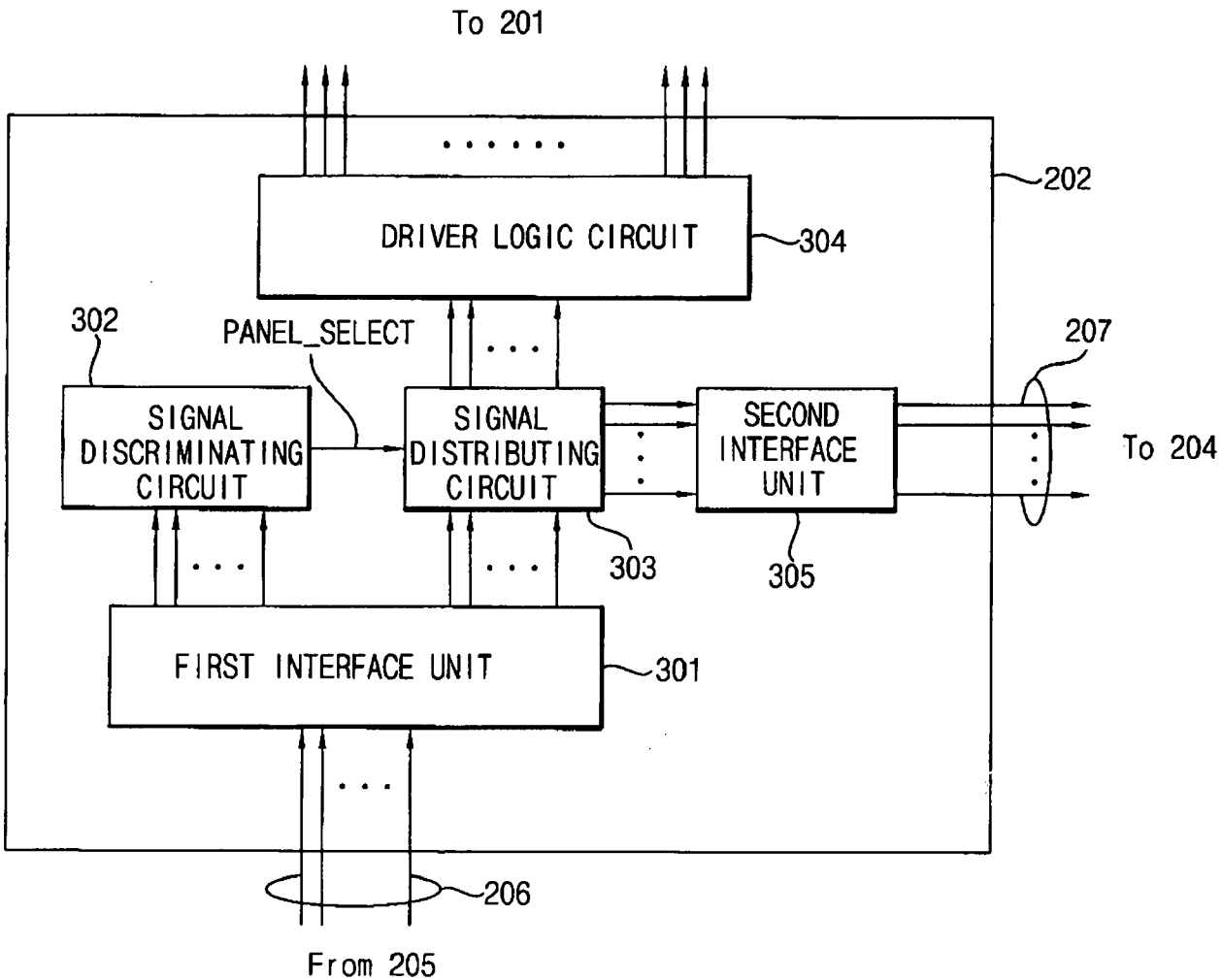
FIG. 3 is a block diagram illustrating a first display driver circuit 202 in the dual-display driver circuit of FIG. 2.

FIG. 3 is a block diagram illustrating a first display driver circuit 202 in the dual-display driver circuit in the dual-display system of FIG. 2.

Referring to FIG. 3, the first display driving circuit 202 includes a first interface unit 301, a signal discriminating circuit 302, a signal distributing circuit (demultiplexing unit) 303, a driver logic circuit 304, and a second interface unit 305.

The first interface unit 301 receives a first display signal and a second display signal from an external source through the first interface 206. The first interface 206 may be a Mobile Digital Display Interface (MDDI). As previously noted, the MDDI is a packet interface that receives/transmits a signal through a serial differential signal line. The first interface unit 301 may be only an MDDI "client" as defined in the MDDI specification, or alternatively may include such an MDDI client. The kinds of packets and detailed configurations related to the MDDI packet interface are disclosed in U.S. Pat. No. 6,760,772 granted to the assignee Qualcomm, Inc.

In case the first interface 206 is a MDDI interface, the first interface unit 301 decodes the MDDI packets that include the first and second display signals to output separately the decoded first and second display signals.

Table 1 includes some of the coded signals, which are related to exemplary embodiments of the present invention wherein the first interface unit 301 decodes MDDI packets, to be decoded by the first interface unit 301 using the MDDI packets.

TABLE 1

| Decoded Signal | Description | Number of Bits |
|---|---|---|
| mddi_byte_clk | A reference clock | |
| mddi_byte_ena | Represents whether one byte information received by the first interface unit is valid or not | |
| fwd_video_params_valid | Has value of '1' when the MDDI packet is a video stream packet and the parameter field of the MDDI packet shows no CRC errors | 1 |
| fwd_pixel_data | One video pixel value, namely, a value | 24 |

TABLE 1-continued

| Decoded Signal | Description | Number of Bits |
|---|---|---|
| | mapped onto a pixel data block of a video stream packet | |
| pixel_data_wr_ena | A signal having a period of one pixel data that has a value of '1' during a half period and a value of '0' during the other half period. | 1 |
| fwd_reg_start_addr | A register address value of a register access packet | 32 (only some of the 32 bits may be usable depending upon exemplary embodiments) |
| fwd_reg_params_valid | Having value of '1' when the MDDI packet is the register access packet and the parameter field of the MDDI packet shows no CRC errors | 1 |
| fwd_reg_data | A parameter of a register data list register of the register access packet | 32 (only some of the 32 bits may be usable depending upon exemplary embodiments) |
| reg_data_wr_ena | A signal having a period of one register data that has a value of '1' during a half period and a value of '0' during the other half period. | |

Table 1 shows signals that are required for driving the first and the second display panels 201 and 203 according to an exemplary embodiment of the present invention. However, in other exemplary embodiments of the present invention, other signals, including some or all of the decoded signals of Table 1 may be required for driving the first and the second display panels 201 and 203.

The signal discriminating circuit 302 discriminates the received first display signal from the received second display signal. The signal discriminating circuit 302 may generate a panel select signal PANEL_SELECT for selecting one of the first display panel 201 and the second display panel 203 as the destination for a received display signal. Particularly, the signal discriminating circuit 302 determines whether the signal outputted from the first interface unit 301 includes the first display signal (for driving the first display panel 201) or instead the second display signal (for driving the second display panel 203) based on some of the decoded signals decoded by the first interface unit 301.

The signal distributing circuit (demultiplexing unit) 303 outputs a selected one of the first display signal and the second display signal, based on a discriminating result (for example, the panel select signal) of the signal discriminating circuit 302. The signal distributing circuit (demultiplexing unit) 303 may simultaneously divide the signals outputted from the first interface unit 301 into the first display signal for driving the first display panel 201 and the second display signal for driving the second display panel 203, based on the discriminating result of the signal discriminating circuit 302, and simultaneously output the first display signal and the second display signal.

The first display signal outputted from the signal distributing circuit (demultiplexing unit) 303 is inputted to the (first) driver logic circuit 304 and is used for driving the first display panel 201.

Thus, the (first) driver logic circuit 304 drives the first display panel 201 based on the first display signal. The (first) driver logic circuit 304 may have a driver circuit for driving the first display panel 201. The driver circuit may vary depending upon the kind of the first display panel 201. The first display panel 201 may be a liquid crystal display (LCD) panel, an organic light-emitting diode (OLED) display panel or any other type of display panel.

The second display signal outputted from the signal distributing circuit (demultiplexing unit) 303 is inputted to the second interface unit 305.

The second interface unit 305 converts the second display signal outputted from the signal distributing circuit (demultiplexing unit) 303 into a signal appropriate (e.g., serial or parallel) for the second interface 207, and outputs the signal appropriate for the second interface 207 to the second display driver circuit 204.

The second interface 207 may be an 80-mode, 16-bit parallel interface or an 80-mode, 18-bit parallel interface when the second display panel 203 is the LCD panel. Alternatively, the second interface 207 may be a serial interface equivalent to or superior to the first interface 206.

Detailed configurations of the signal discriminating circuit 302, the signal distributing circuit (demultiplexing unit) 303 and the second interface unit 305 will be explained further below.

Figure 4:
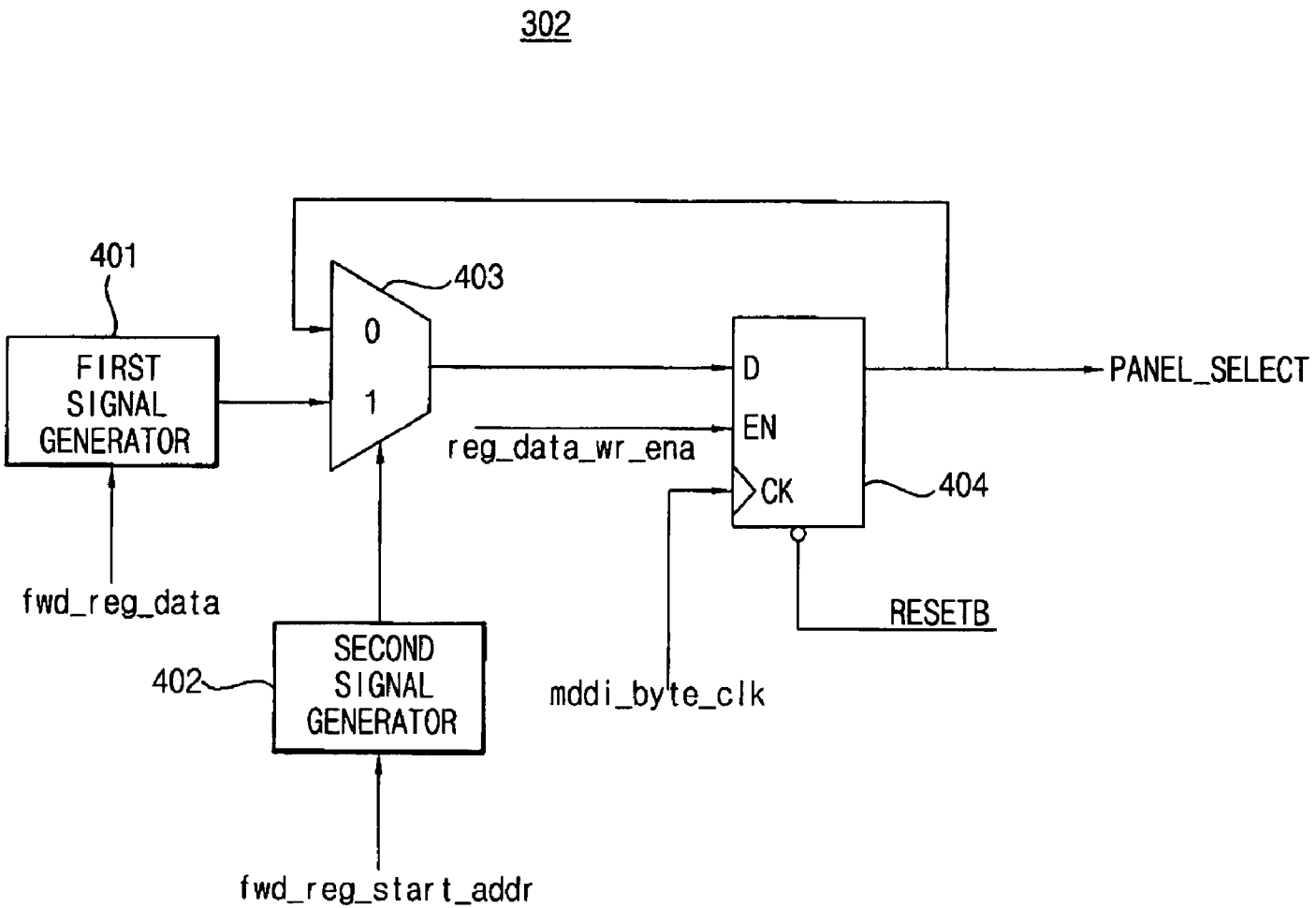
FIG. 4 is a circuit block diagram illustrating a signal discriminating circuit 302 in the first display driver circuit 202 of FIG. 3.

FIG. 4 is a block diagram illustrating a signal discriminating circuit 302 in the first display driver circuit 202 of FIG. 3.

The signal discriminating circuit 302 generates a panel select signal PANEL_SELECT based on receiving (decoded) some of the signals shown in Table 1. The signal distributing circuit (demultiplexing unit) 303 distributes (decoded) signals shown in Table 1 to the driver logic circuit 304 or to the second interface unit 305 based on the PANEL_SELECT signal.

Referring to FIG. 4, the signal discriminating circuit 302 may include a first signal generator 401, a second signal generator 402, a multiplexer 403 and a D flip-flop (latch) 404.

The first signal generator 401 outputs a first (e.g., logic '1') signal to a first input terminal of the multiplexer 403 when the fwd_reg_data has a predetermined value such as a value of '1', and outputs a second (e.g., logic '0') signal to the first input terminal of the multiplexer 403 when the fwd_reg_data does not have the predetermined value such as the value of '1'.

The second signal generator 402 outputs a '1' signal to a selection terminal of the multiplexer 403 when the fwd_reg_start_addr has a predetermined value such as a value of '80h' and outputs a '0' signal to the selection terminal of the multiplexer 403 when the fwd_reg_start_addr does not have the predetermined value such as the value of '80h'.

The multiplexer 403 selects one of a feedback signal (i.e., the PANEL_SELECT signal) and the output signal of the first signal generator 401 in response to the output signal of the second signal generator 402, and outputs the selected one to an input terminal D of the D flip-flop (latch) 404.

The clock signal mddi_byte_clk may be inputted to a clock terminal CK of the D flip-flop (latch) 404. The enable signal reg_data_wr_ena may be inputted to an enable terminal EN of the D flip-flop (latch) 404. A predetermined reset signal RESETB may be inputted to the resting terminal of the D flip-flop (latch) 404.

Thus, the D flip-flop (latch) 404 generates (latches, outputs) the PANEL_SELECT signal having a value of '1' in response to a rising edge of the mddi_byte_clk signal in case the reg_data_wr_ena signal has the value of '1', the fwd_reg_start_addr has the predetermined value such as the value of '80h', and the fwd_reg_data has the predetermined value such as the value of '1'; Conversely, the D flip-flop 404 generates (latches, outputs) the PANEL_SELECT signal having a value of '0' in response to the rising edge of the mddi_byte_clk signal in other cases. The D flip-flop (latch) 404 maintains (latches) the previous (feedback) value of the PANEL_SELECT signal when the mddi_byte_clk signal is not at the rising edge, or when the reg_data_wr_ena signal does not have the value of '1' and the mddi_byte_clk signal is at the rising edge.

The configuration and signals of the signal discriminating circuit 302 in FIG. shows an exemplary implementation of signal discriminating circuit 302, and the configuration and the signals of signal discriminating circuit 302 may be changed.

For example, the fwd_reg_start_addr and the fwd_reg_data respectively used in the first and second signal generators 401 and 402 may be changed to other decoded signals of Table 1 depending upon exemplary embodiments of the present invention.

Figure 5:
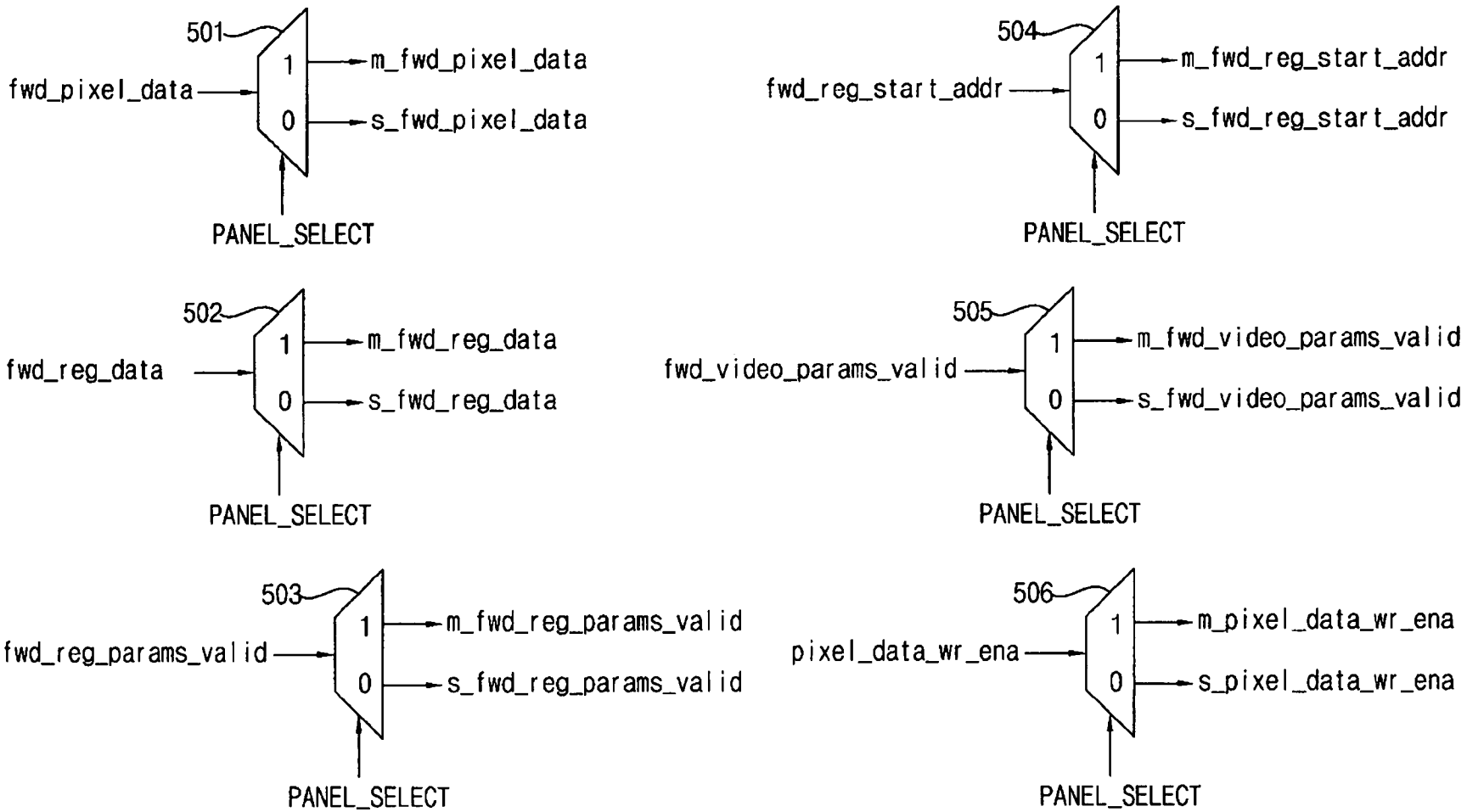
FIG. 5 is a circuit block diagram illustrating a signal distributing circuit 303 in the first display driver circuit 202 of FIG. 3.

FIG. 5 is a circuit block diagram illustrating a signal distributing circuit 303 in the first display driver circuit 202 of FIG. 3.

Referring to FIG. 5, the signal distributing circuit (demultiplexer unit) 303 includes a plurality of parallel demultiplexers 501, 502, 503, 504, 505 and 506 respectively (thus including at least one demultiplexer).

Each of the demultiplexers 501, 502, 503, 504, 505 and 506 selectively output one of the signals outputted from the first interface unit 301 to the driver logic circuit 304 and to the second interface unit 305 in response to the PANEL_SELECT signal outputted from the signal discriminating circuit 302.

A first demultiplexer 501 receives fwd_pixel_data pixel data outputted from the first interface unit 301, and selectively outputs one of m_fwd_pixel_data pixel data and s_fwd_pixel_data pixel data in response to the PANEL_SELECT signal. The m_fwd_pixel_data pixel data are transferred to the driver logic circuit 304 so as to drive the first display panel 201, and s_fwd_pixel_data pixel data are transferred to the second interface unit 305 so as to drive the second display panel 203.

A second demultiplexer 502 receives fwd_reg_data outputted from the first interface unit 301, and selectively outputs one of m_fwd_reg_data and s_fwd_reg_data in response to the PANEL_SELECT signal. The m_fwd_reg_data are transferred to the driver logic circuit 304 so as to drive the first display panel 201, and s_fwd_reg_data are transferred to the second interface unit 305 so as to drive the second display panel 203.

In a similar manner, the third, fourth, fifth and sixth demultiplexers 503 through 506 respectively receive fwd_reg_params_valid, fwd_reg_start_addr, fwd_video_params_valid and pixel_data_wr_ena signals. The third, fourth, fifth and sixth demultiplexers 503 through 506 respectively selectively output first signals (m_fwd_reg_params_valid, m_fwd_reg_start_addr, m_fwd_video_params_valid and m_pixel_ data_wr_ena), and second output signals (s_fwd_reg_params_valid, s_fwd_reg_start_addr, s_fwd_video_params_valid and s_pixel_data_wr_ena), as illustrated in FIG. 5. When selected, the first signals are transferred to the driver logic circuit 304 so as to drive the first display panel 201, and the second signals are transferred to the second interface unit 305 so as to drive the second display panel 203.

The number of demultiplexers included in the first through sixth demultiplexers may vary depending upon the number of the bits of the signals inputted to the respective demultiplexers. For example, the fwd_reg_params_valid signal having one bit is inputted to the third demultiplexer 503, and the third demultiplexer 503 may be implemented with one demultiplexer. For example, the fwd_reg_data signal having 8 bits is inputted to the second demultiplexer 502, and the second demultiplexer 502 may be implemented with two demultiplexers.

Figure 6:
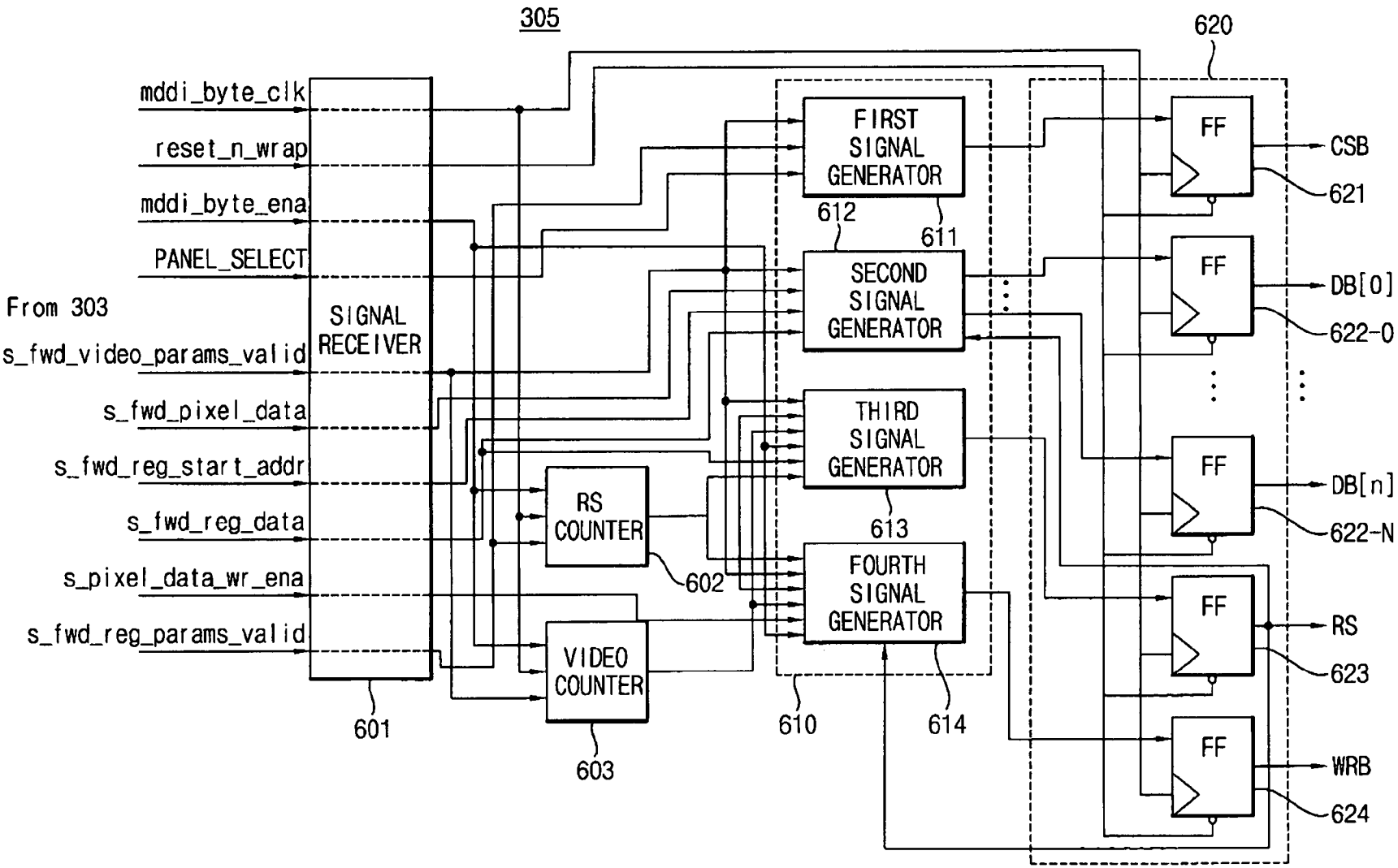
FIG. 6 is a block diagram illustrating a second interface unit 305 in the first display driver circuit 202 of FIG. 3.

FIG. 6 is a block diagram illustrating a second interface unit 305 in the first display driver circuit 202 of FIG. 3.

The second interface unit 305 converts the second display signal outputted from the signal distributing circuit 303 into a signal conforming to the second interface 207. The second interface 207 implemented as shown in FIG. 6 may be an 80-mode, 16-bit parallel interface or an 80-mode, 18-bit parallel interface. However, when an interface different from the second interface 207 implemented as shown in FIG. 6 is selected, the second interface unit 305 may adopt the configuration different from that of the second interface 207 of FIG. 6.

Referring to FIG. 6, the second interface unit 305 includes a signal receiver 601, an RS counter 602, a video counter 603, a signal generating unit 610 and a flip-flop (latching, buffer) unit 620.

The signal generating unit 610 includes first, second, third and fourth signal generators 611, 612, 613 and 614. The first signal generator 611 generates a CSB signal for an 80-mode interface, the second signal generator 612 generates DB signals for the 80-mode interface, the third signal generator 613 generates an RS signal for the 80-mode interface, and the fourth signal generator 614 generates a WRB signal for the 80-mode interface.

The RS counter 602 and the video counter 603 both count the mddi_byte_clk, and respectively determine a time point for toggling the RS signal and a time point for toggling the WRB signal. The RS counter 602 and the video counter 603 may be implemented by shift registers.

For example, the RS counter 602 may include a 7-bit shift register, wherein the 7-bit shift register is shifted every one period of the mddi_byte_clk clock signal when both the fwd_reg_params_valid and the mddi_byte_ena have a value of '1'. The count value of the RS counter 602 is used to determine the transition time (toggle) point of the RS signal of the third signal generator 613 and the WRB signal of the fourth signal generator 614.

Similarly, the video counter 603 may include a 5-bit shift register, wherein the 5-bit shift register is shifted every one period of the mddi_byte_clk clock signal when both the fwd_video_params_valid and the mddi_byte_ena have a value of '1' and the RS signal has a value of '0'. The output of the video counter 603 may be fixed to have a value of '10000b' when the RS signal has a value of '1'.

The signal receiver 601 receives the PANEL_SELECT signal outputted from the signal discriminating circuit 302 and the selected signals outputted from the signal distributing circuit (demultiplexing unit) 303, and transfers the received PANEL_SELECT signal and the signals outputted from the signal distributing circuit 303 to the first through fourth signal generators 611, 612, 613 and 614. The signals outputted from the signal distributing circuit (demultiplexing unit) 303 may include the second display signal.

The CSB signal generated by the first signal generator 611 is a chip select signal of the second display driver circuit 204 coupled to the second interface unit 305 in the first display driver circuit 202 in the dual-display driver circuit of FIG. 2 (see FIGS. 2 and 3). The CSB signal has a value of '0' (to enable the second display driver circuit 204) when display pixel data or a control signal is inputted to the second display driver circuit 204, and has a value '1' (to disable the second display driver circuit 204) when the system is reset or the first display panel 201 is selected.

Thus, the first signal generator 611 receives s_fwd_video_params_valid and s_fwd_reg_params_valid (outputted from the signal distributing circuit 303) and the PANEL_SELECT signal (outputted from the signal discriminating circuit 302), and generates and outputs the CSB signal to the second display driver circuit 204 through the flip-flop (latch) 621 of the flip-flop (latching) unit 620.

The DB signal generated by the second signal generator 612 is a data bus line signal of the second display driver circuit 204 coupled to the second interface unit 305 in the first display driver circuit 202 in the dual-display driver circuit of FIG. 2 (see FIGS. 2 and 3).

Thus, the second signal generator 612 receives s_fwd_pixel_data, s_fwd_reg_start_addr, s_fwd_reg_data and s_fwd_video_params_valid (outputted from the signal distributing circuit 303), and generates and outputs the DB signal through the flip-flops (latches) 622-0, . . . , 622-N of the flip-flop (latching) unit 620.

The number of the flip-flops (latches) 622-0, . . . , 622-N of the flip-flop (latching) unit 620 may vary depending upon the number of DB lines.

The RS signal is an RS line signal of the second display driver circuit 204 coupled to the second interface unit 305.

The RS signal is used to decide whether the DB signal outputted through the DB signal lines (e.g., DB[0] . . . DB[n]) corresponds to a parameter corresponding to a register address or to a register data value to be written to a register or to pixel data value or not. For example, the DB signal outputted through the DB lines corresponds to the parameter corresponding to the register address when the RS signal has a value of '0' and the WRB signal rises; The DB signal outputted through the DB lines corresponds to the register data value or the pixel data value when the RS signal has a value of '1' and the WRB signal rises.

When the DB signal outputted through the DB lines corresponds to the pixel data value, a predetermined parameter corresponding to the register address value may be outputted to the DB signal lines so as to indicate that the data outputted to the DB signal lines are pixel data.

For example, a parameter corresponding to a register address may be outputted to the DB lines while the present RS signal has a value of '0' so as to indicate that the data outputted to the DB signal lines are pixel data, while the next RS signal immediately after the present RS signal has a value of '1'. Accordingly, a parameter corresponding to a register address may be previously assigned.

The register address for outputting the predetermined pixel data may have a value of '22h', etc. and is different from that of the second display driver circuit 204.

The parameter corresponding to the register address may be set through a register included in the first display driver circuit 202, and thus may vary depending upon the configuration of the second display driver circuit 204. Since the parameter corresponding to the register address may be differently set depending upon the manufacturer, design, and configuration of the second display driver circuit 204, the parameter corresponding to the register address may be set using a register in the first display driver circuit 202 so as to enhance the compatibility of the first display driver circuit 202.

The third signal generator 613 of FIG. 3 may refer to a register value of the register in the first display driver circuit 202, and may automatically output (to the DB signal lines, via the second signal generator 612) the parameter corresponding to the register address while the RS signal has a value of '0'.

Thus, the third signal generator 613 of FIG. 3 generates an RS signal having a value of '0' to output the RS signal through the flip-flop (latch) 623 of the flip-flop (latching) unit 620 when the fwd_reg_params_valid signal has a value of '1', the mddi_byte_ena signal has a value of '1' and the count value of the RS counter 602 is not less than 4. In addition, the third signal generator 613 may generate an RS signal having a value of '1' to output the RS signal through the flip-flop 623 of the flip-flop unit 620 when the mddi_byte_ena signal has a value of '1' and the count value of the RS counter 602 is greater than 4.

The third signal generator 613 maintains the value of the previous RS signal when the fwd_reg_params_valid signal has a value of '1' and the mddi_byte_ena signal has a value of '0'.

In addition, the third signal generator 613 maintains the value of the RS signal as '0' during a predetermined clock period (such as four or five clock periods) when the fwd_video_params_valid signal outputted from the signal distributing circuit 303 (FIG. 3) has a value of '1', so as to output the parameter corresponding to the register address to the DB signal lines, while the RS signal has a value of '0' for the purpose of indicating that the data to be outputted to the DB signal lines are the pixel data.

The WRB signal generated by the fourth signal generator 614 is a WRB line signal of the second display driver circuit 204 coupled to the second interface unit 305. The WRB signal indicates that a DB signal is outputted to the DB signal lines.

Thus, the fourth signal generator 614 generates a WRB signal that is toggled depending upon a count value from the RS counter 602 when the fwd_reg_params_valid signal has a value of '1' and the mddi_byte_ena signal has a value of '1', and outputs the WRS signal through the flip-flop (latch) 624 of the flip-flop (latching) unit 620. For example, the fourth signal generator 614 generates a WRB signal having a value of '0' in case the count value from the RS counter 602 has a value of '0000010b' or '0001000b', and in other cases, generates a WRB signal having a value of '1'.

The fourth signal generator 614 also generates a WRB signal that is toggled depending upon a count value of the video counter 603 when the fwd_video_params_valid signal has a value of '1' and the mddi_byte_ena signal has a value of '1'. For example, the fourth signal generator 614 generates a WRB signal having a value of '0' in case the count value of the video counter 603 has a value of '00001b', and in other cases, generates a WRB signal having a value of '1'.

The 80-mode interface signals generated by the first through fourth signal generators 611, 612, 613 and 614 are synchronized all together by the flip-flop (latching, buffering) unit 620 to be outputted (e.g., in parallel, or synchronized with the mddi_byte_clk signal).

The flip-flops (lathes) 621, 622-0, . . . , 622-N, 623 and 624 included in the flip-flop (latching) unit 620 receive the mddi_byte_clk signal at their clock nodes, receive the signals outputted from connected signal generators 611, 612, 613 and 614 at their input nodes, and output CSB, RS, DB and WRB signals synchronized with the mddi_byte_clk signal.

Figure 7A:
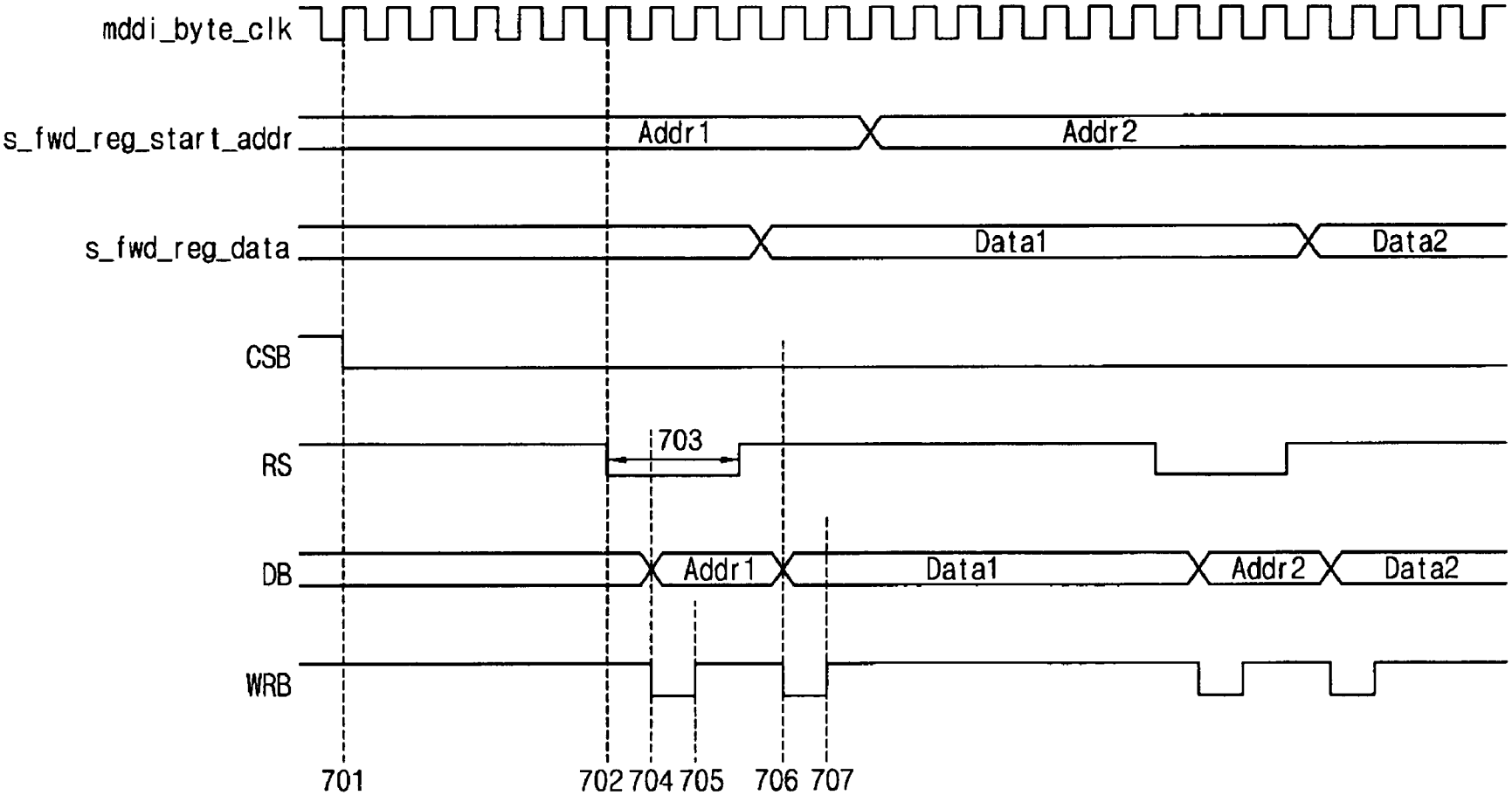
FIGS. 7A and 7B are timing diagrams illustrating an operation of the second interface unit 305 of FIG. 6.
Figure 7B:
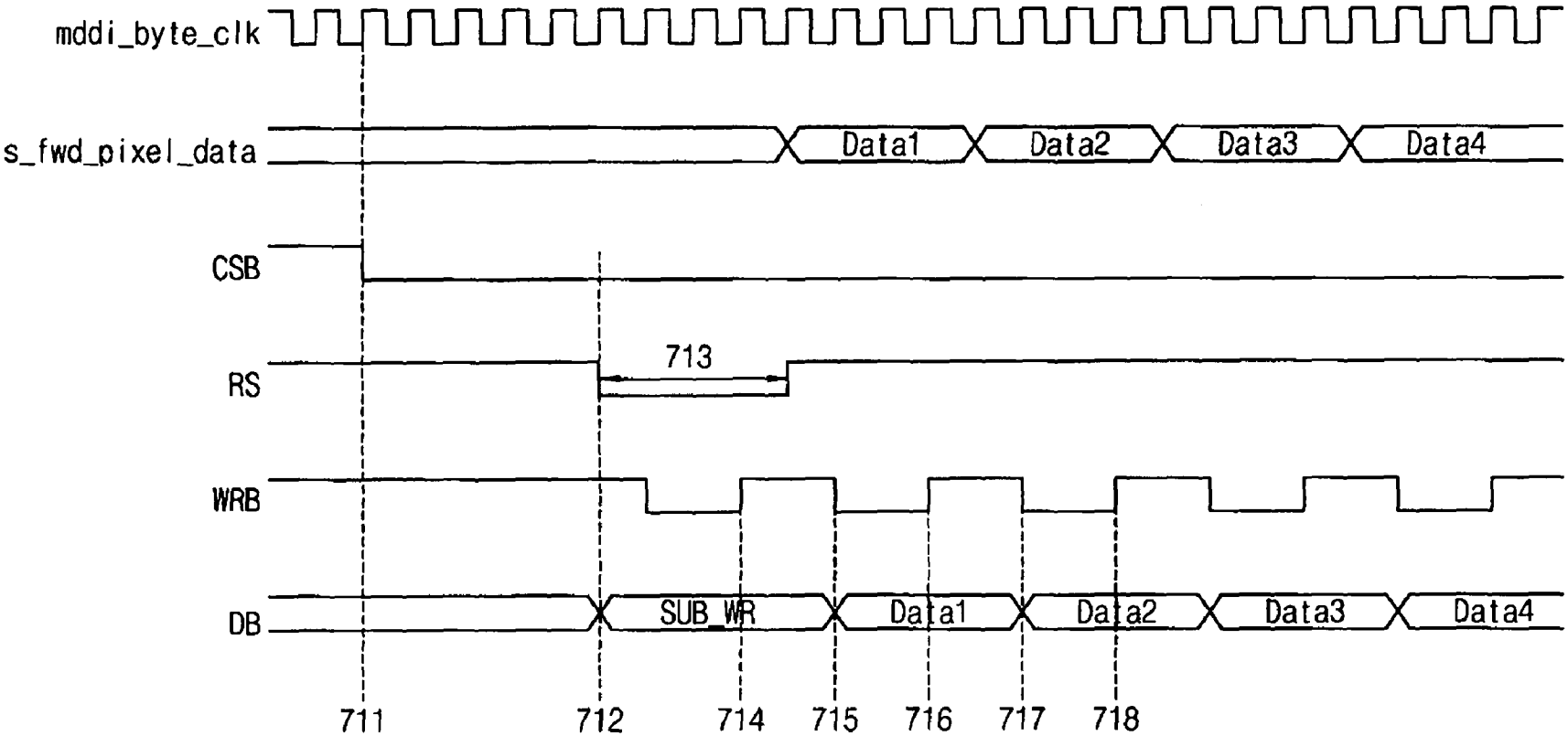

FIGS. 7A and 7B are timing diagrams illustrating an operation of the second interface unit 305 of FIG. 6.

FIG. 7A is a timing diagram for illustrating that the second interface unit 305 of FIG. 6 outputs parameters corresponding to a register address and to the register data value via the second interface 207 (FIG. 2).

Referring to FIG. 6 and FIG. 7A, the chip select signal CSB is transitioned (by the first signal generator 611 in FIG. 6) to have a value '0' at the first time point 701. The RS signal is transitioned (by the count operation of the RS counter 602 and by the third signal generator 613 in FIG. 6) to have a value '0' at the second time point 702, and is maintained as the value of '0' during three clock periods 703 of the mddi_byte_clk signal.

The RS signal having the value of '0' is outputted when the parameter corresponding to the register address is outputted to the DB signal lines, and the RS signal having the value of '1' is outputted when the register data are outputted to the DB signal lines.

The second signal generator outputs the s_fwd_reg_start_addr signal outputted from the signal distributing circuit (demultiplexer unit) 303 to the DB signal lines at the third time point 704. The WRB signal is raised at the fourth time point 705 (by the count operation of the video counter 604 and by the fourth signal generator 614), to indicate that the DB signal is outputted to the DB signal lines.

The second signal generator 612 outputs the s_fwd_reg_ data signal outputted from the signal distributing circuit 303 to the DB signal lines at the fifth time point 706. The WRB signal is raised at the sixth time point 707 (by the count operation of the RS counter 602 and by the fourth signal generator 614), and indicates that the DB signal is outputted to the DB signal lines.

FIG. 7B is a timing diagram for illustrating that the second interface unit 305 of FIG. 6 outputs the register data value via the second interface 207 (FIG. 2).

Referring to FIG. 6 and FIG. 7B, the CSB signal is transitioned to have a value '0' at the first time point 711 by the first signal generator 611. The RS signal is transitioned (by the third signal generator 613 and by the count operation of the RS counter 602) to have a value '0' at the second time point 712. The RS signal is maintained as the value of '0' during predetermined clock periods 713 of the mddi_byte_clk signal such as four or five three clock periods of the mddi_byte_clk signal so as to output the parameter corresponding to the register address in advance for the purpose of indicating that the data to be outputted to the DB signal lines is pixel data.

At the second time point 712, the second signal generator 612 automatically outputs the parameter corresponding to the register address to the DB signal lines. The WRB signal is raised (by the count operation of the video counter 603 and by the fourth signal generator 614) at the third time point 714, and indicates that the parameter corresponding to the register address is outputted to the DB signal lines.

The RS signal is maintained as a value of '1' while the pixel data are outputted to the DB signal lines.

After the fourth time point 715, the second signal generator 612 sequentially outputs s_fwd_pixel_data (DATA1, DATA2, DATA3, . . . ) from the signal distributing circuit 303 (FIG. 3) to the DB signal lines, and the fourth signal generator 614 continuously toggles the WRB signal in response to the count operation of the video counter 603 at the corresponding time points 716, 718, . . . so as to indicate that the DB signal is outputted to the DB signal lines.

According to the above-described multi-display driver circuit (e.g., dual-display driver circuit), the first driving circuit for driving the first display panel, and the second driving circuit for driving the second display panel may be designed using a single high-speed interface, with the CPU.

Thus, the complexity of the wiring between the CPU and the display panels may be reduced, and the EMI characteristics may be enhanced compared with the multi-display driving circuit that is implemented using the conventional parallel interface.

While the exemplary embodiments of the present invention and their advantages have been described in detail, it should be understood that various changes, substitutions and alterations may be made herein without departing from the scope of the invention. As used herein, the term "display driving circuit" includes a "multi-display driver circuit", and the term "multi-display driver circuit" includes a "dual-display driver circuit", a triple-display driver circuit, etc., or a driver circuit configured to drive only one of a plurality of displays at a time.

What is claimed is:

1. A display driving unit comprising:

a first display driving circuit for driving a first display having a first resolution, and configured:

to receive a first display signal having a serial data format and a second display signal through a first interface, the first interface being a serial differential interface;

to drive a first display panel with the first display signal;

to convert the second display signal having a serial data format into a signal having a parallel data format conforming to a second interface, the second interface being a parallel interface; and to output the converted second display signal through the second interface to a second display driving circuit for driving a second display panel having a second resolution not equal to the first resolution, wherein the first interface is a packet interface, and the first and the second display signals are inputted as encoded packet data to the first display driving circuit from an external source, wherein the first display driving circuit includes:

a first interface unit configured to receive the first display signal and the second display signal through the first interface;

a signal discriminating circuit configured to discriminate the received first display signal from the received second display signal;

a signal demultiplexing circuit configured to output a selected one of the first display signal and the second display signal based on a discriminating result of the signal discriminating circuit;

a driver logic circuit configured to drive the first display panel with the first display signal; and a second interface unit configured to convert the second display signal outputted from the signal demultiplexing circuit into a signal conforming to the second interface and to output the conformed second display signal conforming to the second interface, and wherein the signal discriminating circuit generates a panel select signal for selecting one of the first display panel and the second display panel based on at least one of the first and the second display signals.

2. The display driving unit of claim 1, wherein the first interface is a Mobile Digital Display Interface (MDDI).

3. The display driving unit of claim 1, wherein the first display signal includes first pixel data and a first control signal for driving pixels of the first display panel, and the second display signal includes second pixel data and a second control signal for driving pixels of the second display panel.

4. The display driving unit of claim 1, wherein the signal demultiplexing circuit demutiplexes signals outputted from the first interface unit into the first display signal and the second display signal and outputs a selected one of the first display signal and the second display signal in response to the panel select signal.

5. The display driving unit of claim 4, wherein the first display signal includes first pixel data and a first control signal for driving the first display panel, and the second display signal includes second pixel data and a second control signal for driving the second display panel, and wherein the signal demultiplexing circuit includes at least one demultiplexer configured to perform a demultiplexing operation on the first pixel data and the second pixel data in first display signal in response to the panel select signal.

6. The display driving unit of claim 1, wherein the second interface is an 80-mode parallel interface, and the second interface unit includes:

a signal receiver configured to receive the second display signal outputted from the signal demultiplexing circuit;

a first counter and a second counter configured to count a clock signal to determine a transition time point for toggling a signal conforming to the 80-mode parallel interface;

a signal generating unit configured to generate a conformed second display signal conforming to the 80-mode parallel interface based on the second display signal, a first count value of the first counter and a second count value of the second counter; and a latching unit having a plurality of latches configured to transfer the conformed second display signal conforming to the 80-mode parallel interface in response to the clock signal.

7. The display driving unit of claim 1, wherein a second display driving circuit is configured to drive the second display panel in response to the second display signal outputted through the second interface.

* * * * *